US005584363A

United States Patent [19]

Curtin et al.

[11] Patent Number: 5,584,363

[45] Date of Patent: Dec. 17, 1996

[54] LOCKING SYSTEM FOR STABILIZERS

[75] Inventors: Richard M. Curtin, Redmond; Paul K. Smith, Kirkland; Matthew G. Kraemer, Seattle, all of Wash.

[73] Assignee: Genie Industries, Redmond, Wash.

[21] Appl. No.: 228,800

[22] Filed: Apr. 18, 1994

[51] Int. Cl.[6] ..... B66B 9/16

[52] U.S. Cl. ..... 187/243; 187/232; 187/242; 280/764.1; 212/306; 212/901

[58] Field of Search ..... 414/592, 673; 212/302, 306, 901; 280/763.1, 764.1, 43.17; 187/232, 242, 243; 403/330

[56] References Cited

U.S. PATENT DOCUMENTS

| | | | |
|---|---|---|---|
| 3,704,799 | 12/1972 | Morris, Jr. | 187/232 X |
| 3,957,137 | 5/1976 | Vermette | 187/232 |
| 4,068,737 | 1/1978 | Lenz | 187/243 X |
| 4,131,181 | 12/1978 | Vermette | 187/232 |
| 4,417,746 | 11/1983 | Baron | 280/763.1 X |
| 4,588,346 | 5/1986 | Smith | 414/673 |
| 4,987,976 | 1/1991 | Daugherty | 187/243 |

FOREIGN PATENT DOCUMENTS

| | | | |
|---|---|---|---|
| 1401007 | 6/1988 | U.S.S.R. | 187/232 |

*Primary Examiner*—David A. Bucci
*Assistant Examiner*—Stephen Gordon
*Attorney, Agent, or Firm*—Seed and Berry LLP

[57] ABSTRACT

A swing-up stabilizer for a portable lift has a bracing strut with a pivoted locking mechanism at its upper end including a locking plate on the strut which is spring biased into a tilted locking position biting the strut when the stabilizer is in an active ground engaging position or swung into a raised storage position located past an "at center" position whereat the strut is aligned with a pivotal connection between the strut and stabilizer.

3 Claims, 4 Drawing Sheets

LOCKING SYSTEM FOR STABILIZERS

TECHNICAL FIELD

The present invention relates to stabilizers on portable lifts which move between a ground-engaging position for stabilizing the lift against tilting of its mast and a raised inactive storage position.

BACKGROUND OF THE INVENTION

It is preferred that portable lifts be narrow enough to be moved through doorways. However, when the lifts are used at the job sites they frequently require lateral stabilization with ground engagement "foot prints" which are further apart than normal door width. Hence, laterally extending stabilizers have been employed which can be moved into an inactive storage position on the lift which effectively narrows the lift to less than door width. Some of the stabilizers used in the past have swung down from an upright storage position to an active ground-engaging position. Some of these swing-down stabilizers have had folding struts hinged at the center similar to common card table braces to hold the stabilizers in active position, and others have had ratcheting mechanisms limited to ratchet teeth positions for adjustment. A need has arisen for an improved locking system for swing-down stabilizers which automatically locks the stabilizer in both lowered and raised positions, is easy and safe to operate, and is of economical and sturdy construction.

SUMMARY OF THE INVENTION

In accordance with the present invention a fold-down stabilizer is provided with a strut which is pivotally connected at one end to the stabilizer and passes upwardly at its other end through a clamp housing which is pivoted at an offset pivot element. The clamp housing contains a latch plate(s) loosely fitting on the strut and a compression spring sleeved on the strut to bias the latch plate into engagement with the pivot element for the clamp housing. This arrangement tilts the latch plate relative to the longitudinal axis of the strut bar away from the stabilizer and causes the latch plate to bite the strut and resist endwise movement thereof relative to the clamp housing in a direction increasing the length of strut between the clamp housing and the stabilizer.

To enable the stabilizer to be swung upwardly the latch is manually released by pulling the latch plate against the spring pressure to a perpendicular position relative to the strut longitudinal axis. When the stabilizer has been then swung upwardly to an over center position and the latch plate is released so that it again can assume a tilted position on the strut, the latch plate locks the stabilizer in its raised position because the dimension between the latch plate and the pivotal connection between the strut and the stabilizer begins to increase when the stabilizer is raised past the "center" position where the longitudinal axis of the strut intersects the pivot axis of the strut on the stabilizer. Hence, the stabilizer is automatically locked in its active and storage positions.

DETAILED DESCRIPTION OF THE INVENTION

Figure 1:
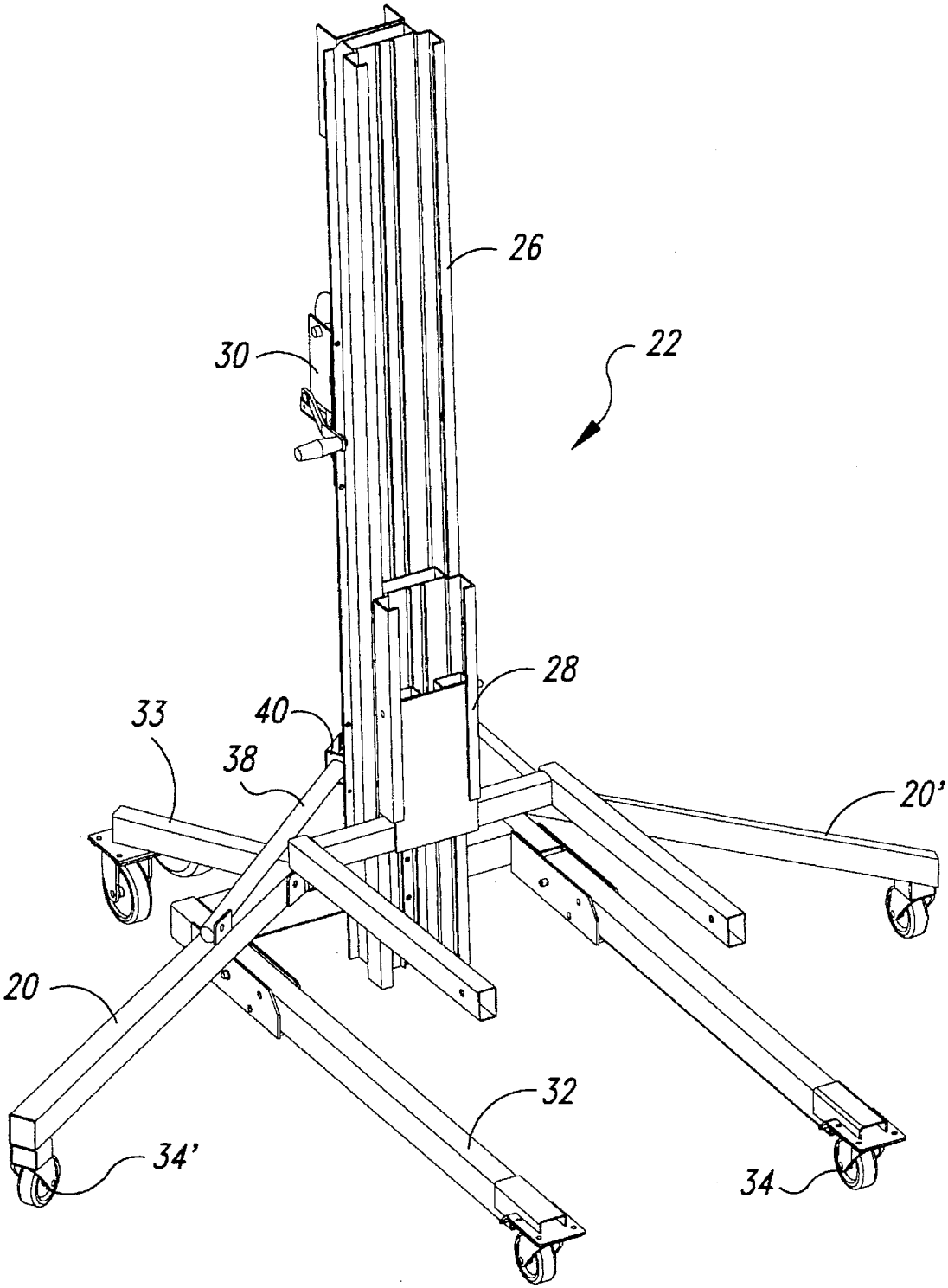
FIG. 1 is a perspective view of a portable lift embodying the invention and shown with the stabilizers in lowered active position.

Referring to the drawings, the present invention is illustrated as applied to a pair of swing-down stabilizers 20, 20' on a portable lift 22 having a base 24 on which a mast 26 is mounted. A load support carriage assembly 28 is slide mounted on the front of the mast 26 and is raised and lowered by a reeving system (not shown) responsive to operation of a winch 30 mounted on the back of the mast. Front and rear pairs of reach arms 32 and 33 extends from the base 24 and have casters 34 at their outer ends. The outer ends of the stabilizers also have casters 34'.

The stabilizers 20 are pivoted adjacent the bottom of the mast on a respective swing axis defined by a bolt 36 to occupy active positions overlying and extending at cross-angles to the forwardly extending reach arms 32. Since the mechanisms relating to the operation of the two stabilizers 20 can be identical, only the one for the right hand side of the lift will be described. A sloping strut 38, preferably of round bar or pipe stock, is pivoted at bolt 39 to the stabilizer and slopes upwardly to pass through a clamp housing 40 which is pivotally connected by a through bolt 41 to a bracket 42 fixed to the back of mast 26. A tube 43 is sleeved on the bolt 41 within the housing 40. The clamp housing 40 may comprise a short length of square tubing formed with a pair of aligned slide openings **40*a* for receiving the strut 38. A cross-pin 44 extending through the strut 38 at its free end retains the strut. The longitudinal axis of the strut is offset from the swing axis of the housing 40 at bolt 41**.

Figure 2:
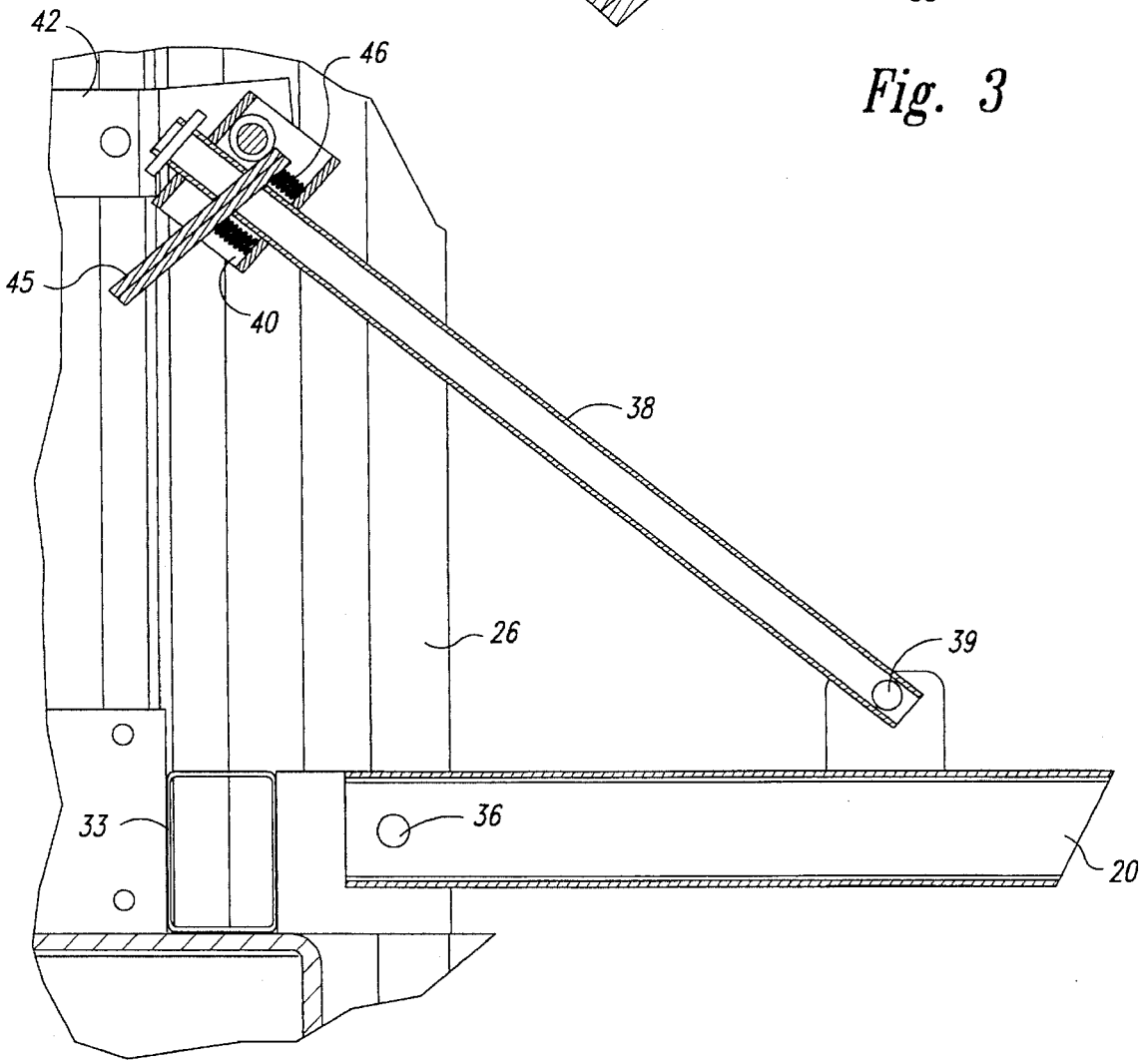
FIG. 2 is a fragmentary vertical sectional view through the strut and related mechanism when the stabilizer is in lowered ground engaging position.

A pair of face-to-face latch plates 45 are loosely mounted on the strut 38 within the housing 40 and project out the open end of the clamp housing 40 most remote from the bolt 41. A compression spring 46 in the housing 40 is sleeved on the strut 38 and biases the latch plates 45 against the tube 43 on bolt 41 as a fulcrum. As a result, the latch plates 45 are tilted on the strut 38 away from the stabilizer (FIG. 2) and bite into the strut if the strut is forced endwise relative to latch plates 44 and housing 40 in a direction "extending" the strut, i.e., a direction increasing the length of strut between the clamp housing 40 and the pivotal connection 39 of the strut with the stabilizer 20.

Figure 3:
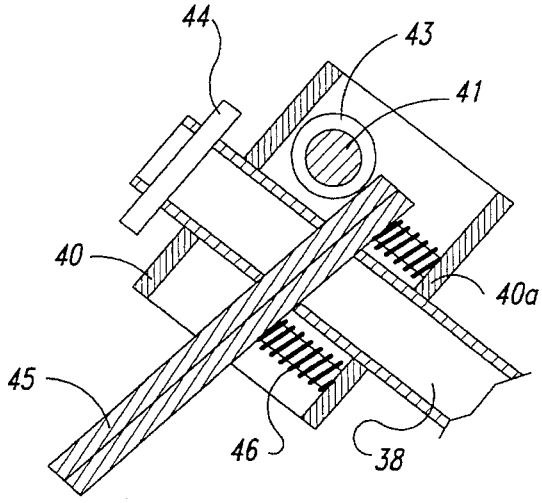
FIG. 3 shows the latch plates in released position.
Figure 5:
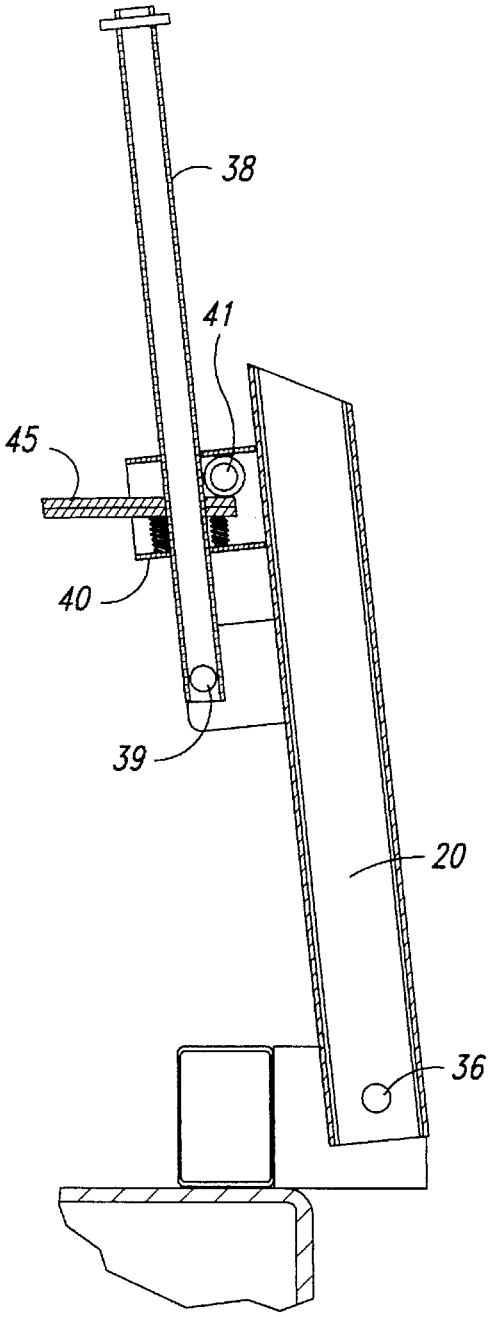
FIGS. 4 and 5 illustrate the stabilizer raised to the "at center" position and "past center" locked storage position, respectively.
Figure 4:
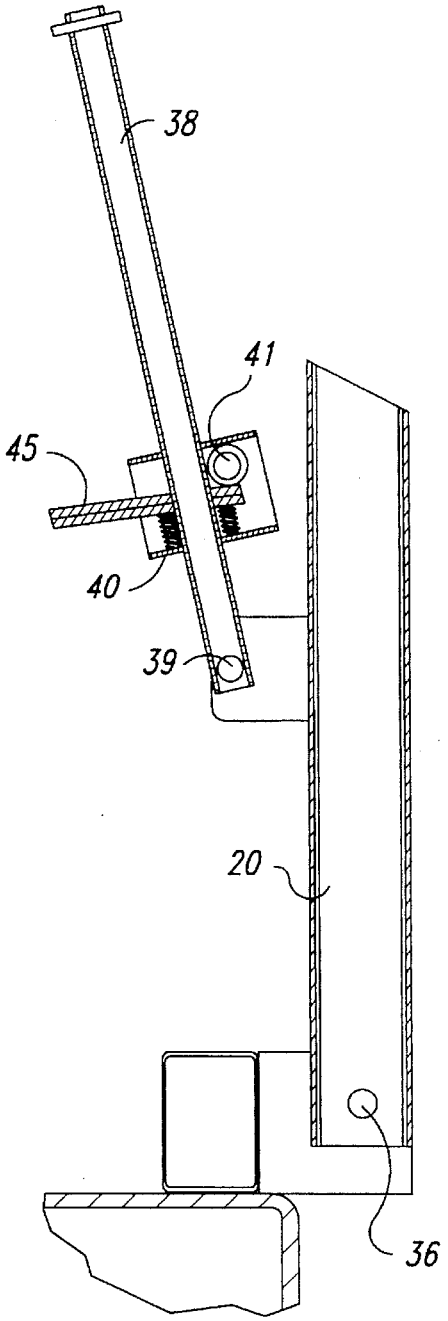
Figure 6:
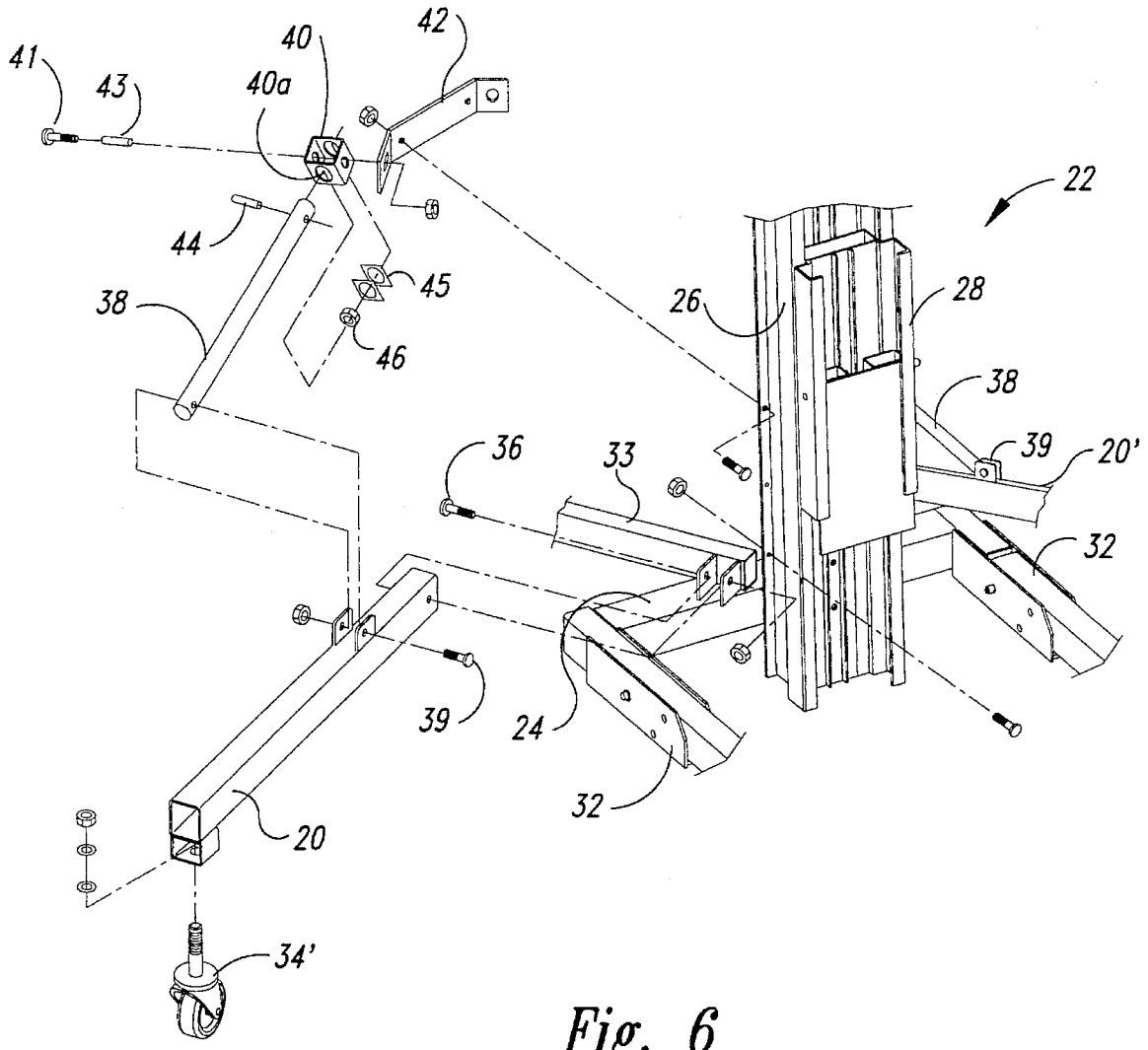
FIG. 6 is an exploded view of the locking mechanism and related parts.

The raised swing-up storage position of the stabilizer 20 on swing axis 36 is purposely more than 90 degrees from the swing-down active position of the stabilizer. The geometry is such that when the stabilizer 20 is being swung toward its storage position the distance between the clamp housing 40 and the strut pivot 39 on the stabilizer decreases until the longitudinal axis of the strut passes through the pivot axis 36 of the stabilize 20, the "at center" position shown in FIG. 4. Then, as the stabilizer is swung farther ("past center") to reach its storage position, the distance between the clamp housing 40 and the strut pivot 39 increases. This assures that when the latching plates are in their normal active tilted position they will resist swing-down of the stabilizer when the stabilizer is in its raised storage position (FIG. 5). Thus, it is seen that the locking mechanism is effective when the stabilizer is in its active position or in its storage position. In each instance the locking mechanism is easily manually released by pushing the latch plates 45 to a release position (FIG. 3) whereat the latch plates are perpendicular to the longitudinal axis of the strut 38.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A portable lift with a stabilizer locking system comprising:

a base;

a mast supported on the base;

a stabilizer swing-mounted on said base at a stabilizer swing axis to move from an active ground-engaging stabilizing position to a raised inactive storage position;

a damp housing swing mounted at a pivot axis adjacent said mast which is higher than the elevation of said stabilizer swing axis;

a strut pivotally connected to said stabilizer at a strut swing axis and slidably passing through said damp housing along a slide axis offset from said pivot axis;

a latch plate loosely sleeved on said strut bar in said housing and projecting away from said pivot axis;

a fulcrum in said clamp housing adjacent said pivot axis;

a compression spring sleeved on said strut and seated in said damp housing such as to engage said latch plate and bias it along said strut into engagement with said fulcrum thereby tilting the latch plate relative to the strut into a latching position whereat the tilted latch plate resists sliding movement of the strut through the clamp housing;

said strut being releasable by manually pulling the projecting portion of the latch plate from its latching position into a release position perpendicular to the strut so that said stabilizer can then be swung between its active and storage positions, the distance between said latch plate and said strut swing axis decreasing as said stabilizer is swung upwardly to a center position whereat the longitudinal axis of the strut intersects said stabilizer swing axis, and then increasing before the stabilizer fully reaches its inactive storage position, said tilting of the latch plate relative to the strut when the stabilizer is in its active and storage positions preventing swinging movement of the stabilizer.

2. A portable life with a stabilizer locking system according to claim 1 in which said fulcrum is a sleeve surrounding said pivot axis.

3. A portable lift with a stabilizer locking system according to claim 1 in which there is a second latch plate loosely sleeved on said strut and positioned between said first-mentioned latch plate and said fulcrum to coact with said first mentioned latch plate.

* * * * *

UNITED STATES PATENT AND TRADEMARK OFFICE

CERTIFICATE OF CORRECTION

PATENT NO. : 5,584,363
DATED : December 17, 1996
INVENTOR(S) : Richard M. Curtin et al.

It is certified that error appears in the above-indentified patent and that said Letters Patent is hereby corrected as shown below:

In column 3, claim 1, line 22, please delete "damp" and insert therefor --clamp--.

In column 3, claim 1, line 26, please delete "damp" and insert therefor --clamp--.

In column 4, claim 1, line 1, line 2, please delete "damp" and insert therefor --clamp--.

In column 4, claim 2, line 22, please delete "life" and insert therefor --lift--.

Signed and Sealed this

Twenty-fourth Day of June, 1997

Bruce Lehman

*Attest:*

BRUCE LEHMAN

*Attesting Officer*

*Commissioner of Patents and Trademarks*